US008834491B2

(12) United States Patent
Perach et al.

(10) Patent No.: US 8,834,491 B2
(45) Date of Patent: Sep. 16, 2014

(54) HAIR REMOVAL DEVICE AND METHOD

(76) Inventors: Benjamin Perach, Hadera (IL); Sharon Perach, Hadera (IL)

( * ) Notice: Subject to any disclaimer, the term of this patent is extended or adjusted under 35 U.S.C. 154(b) by 11 days.

(21) Appl. No.: 13/132,142

(22) PCT Filed: Dec. 2, 2009

(86) PCT No.: PCT/IB2009/055459

§ 371 (c)(1),
(2), (4) Date: Jun. 1, 2011

(87) PCT Pub. No.: WO2010/064201

PCT Pub. Date: Jun. 10, 2010

(65) Prior Publication Data

US 2011/0238087 A1 Sep. 29, 2011

(30) Foreign Application Priority Data

Dec. 2, 2008 (IL) ..... 195642

(51) Int. Cl.
*A61B 17/50* (2006.01)

(52) U.S. Cl.
USPC ..... 606/134

(58) Field of Classification Search
USPC ..... 606/131–134; D24/188, 189; 452/71, 452/72
See application file for complete search history.

(56) References Cited

U.S. PATENT DOCUMENTS

| | | | | |
|---|---|---|---|---|
| 2,423,245 | A * | 7/1947 | Magnus et al. | 606/134 |
| 4,282,877 | A * | 8/1981 | Mathews | 606/134 |
| 6,939,354 | B1 | 9/2005 | Taghaddos | |
| 2007/0038228 | A1 * | 2/2007 | Ramusch et al. | 606/133 |

FOREIGN PATENT DOCUMENTS

| | | |
|---|---|---|
| EP | 0738481 | 10/1996 |
| FR | 2747278 | 10/1997 |
| JP | 2002191429 | 7/2002 |
| JP | 2001261538 | 8/2011 |
| WO | WO2004016127 | 2/2004 |

* cited by examiner

*Primary Examiner* — Ryan Severson
*Assistant Examiner* — Anh Dang
(74) *Attorney, Agent, or Firm* — Patwrite Law; Mark David Torche

(57) ABSTRACT

A hair removal device and method using, or for use in combination with, a wax-strip, the device comprising: a user holding member; a wax-strip engagement mechanism for removable engagement with the wax-strip; and a wax-strip removal mechanism comprising a wax-strip removal acceleration arrangement, wherein the wax-strip removal mechanism is disposed, or adjustable, to apply a pulling force on the wax-strip at an angle or a range of angles relative to the skin including essentially parallel to the skin.

6 Claims, 18 Drawing Sheets

Fig. 6c
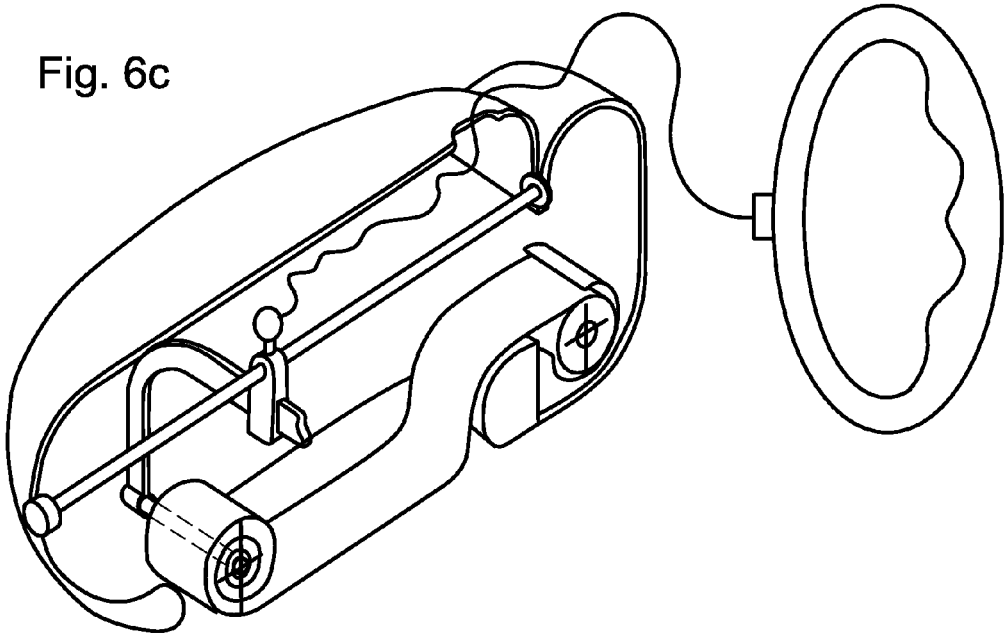
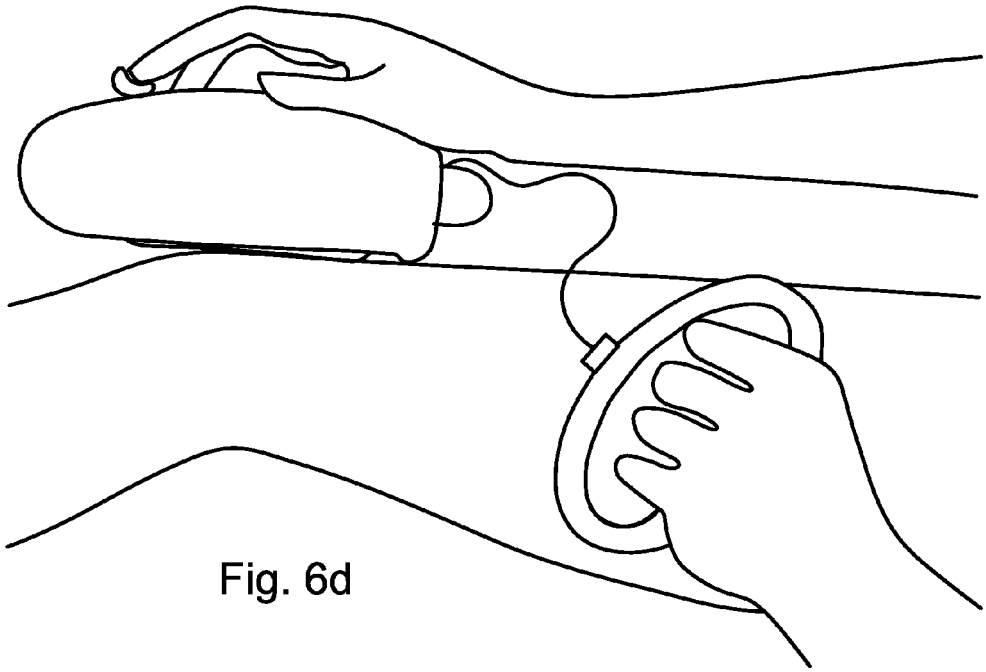
Fig. 6d

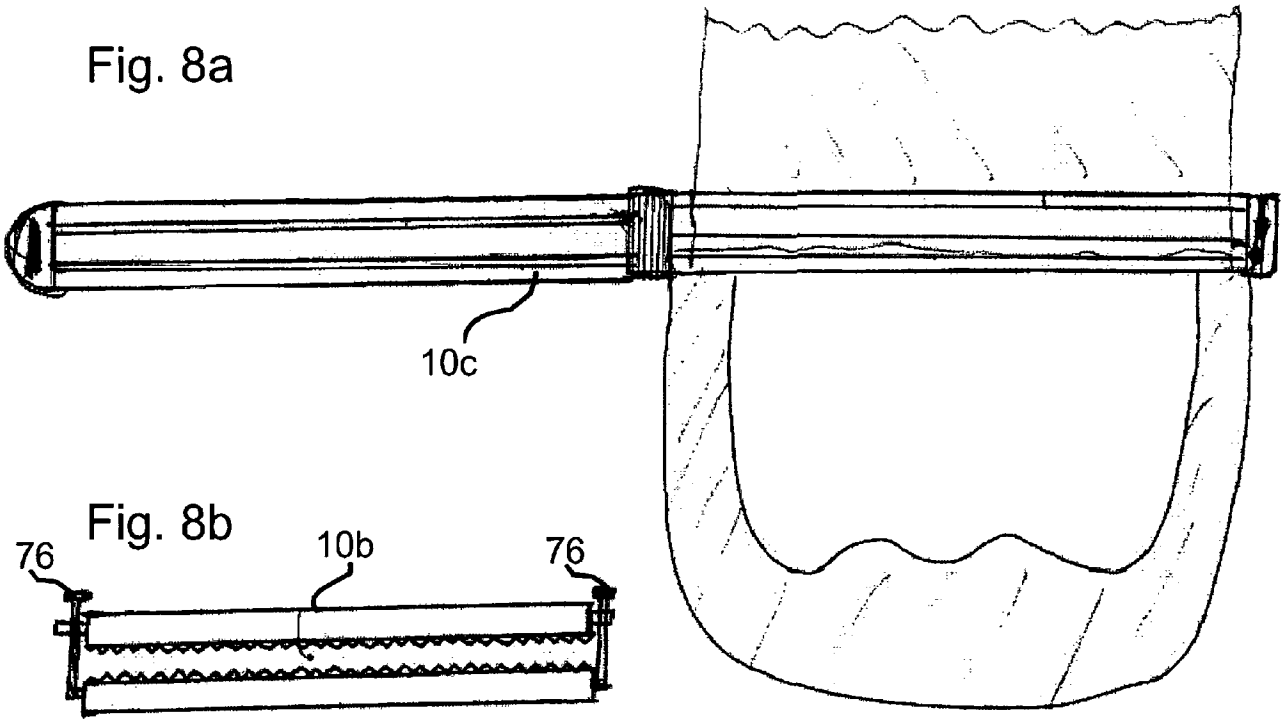
Fig. 8a
Fig. 8b
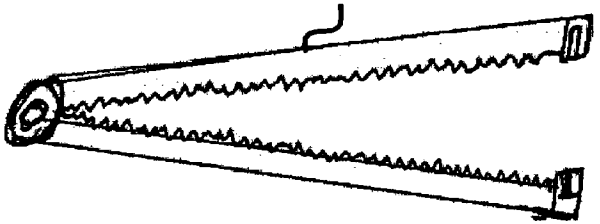
Fig. 8c

E2

10d

10e
E3

E4
77
E4
77

81
79
85
83

112

114

114

116

116

118

120

122

HAIR REMOVAL DEVICE AND METHOD

FIELD OF THE INVENTION

The present invention relates to cosmetic devices, more particularly a device and method for hair removal.

BACKGROUND OF THE INVENTION

The use of wax-strips is a popular and cost effective means of hair removal and many companies provide related products and countless beauticians provide such services. First, wax is spread, typically after heating, on the area of the skin having the undesired hair; although in some cases the wax-strip has wax on/in it already. Then the strip is placed on top of the wax, the beautician or user then rubs a hand over the strip, back and forth and the strip is pulled off, usually rapidly, against the direction of the hair growth, and at a relatively low angle with respect to the skin.

Regardless the popularity of the treatment, a common issue is that removal of the strip can cause a fair amount of pain; and in many cases some hair is not removed with the initial removal of the strip and it must be repeated.

It is believed that publications EP 0738481; US2005/283169; US 2007/038228; and FR 2,747,278 disclose representative prior art hair removal devices that use wax-strips or are used in combination with wax-strips.

SUMMARY OF THE INVENTION

The present invention relates to a device or appliance for removing hair using, or in combination with, wax-strips; and a method for such hair removal.

In accordance with embodiments of one aspect of the present invention there is provided a hair removal device using, or for use in combination with, a wax-strip, the device comprising: a user holding member (e.g. a housing or a handle); a wax-strip engagement mechanism for removable engagement with the wax-strip; and a wax-strip removal mechanism comprising a wax-strip removal acceleration arrangement, wherein the wax-strip removal mechanism is disposed, or adjustable, to apply a pulling force on the wax-strip at an angle or a range of angles relative to the skin including essentially parallel to the skin.

The term 'wax-strips' herein the specification and claims will be used in its broadest sense and include any strips or tape that contain an adhesive material or any other hairengaging material or configuration, pressure sensitive adhesive or otherwise, therein or thereon the strips; strips usable with wax or other hair removal compounds; or other strip-like material, including an elastic strip or patch, or strip with a elastic portion, with a plurality of slits, the slits being openable to allow hair to enter therein and closable to hold the hair while the strip/patch is removed from the skin; a frame with a flexible hair-grabbing mechanism or member(s) such as elastic bands or springs; a wax-strip arrangement comprising a plurality of stacked or layered strips.

It is a particular feature of the present device that a member of the wax-strip removal mechanism (e.g. a rod for guiding the force of a spring, elastic member/portion, a reactive acceleration such as used for example in automobile air-bags, a hydraulic arrangement, a compressed gas, for example in a balloon or tank, or the like) is arranged, or is adjustable to be, essentially parallel to the skin of the user.

In accordance with embodiments of another aspect of the present invention there is provided a method of removing hair from skin using a wax-strip comprising: arranging the wax-strip, in combination with a hair removal device, on the skin; and actuating the hair removal device to pull the wax-strip from the skin at an angle or a range of angles relative to the skin including essentially parallel to the skin.

Without limitation to theory, it is believed that improved hair removal and/or reduced pain and/or other benefits using the present device and method is a result of the high speed at which the strip is pulled and/or that the speed of pulling, in particular at the beginning of the pulling (wax-strip removal) process is high and/or that the appliance facilitates a low pulling angle relative to the skin and/or that the angle of pulling can be adjusted.

BRIEF DESCRIPTION OF THE DRAWINGS

The invention may be understood upon reading of the following detailed description of non-limiting exemplary embodiments thereof, with reference to the following drawings, in which:

FIGS. 6*a*-6*g* are schematic views showing further embodiments of the hair removal device in a hand-operated implementation of the present invention;

FIGS. 8*a*-8*c* show another embodiment of the hair removal device relating to a wax-strip engagement mechanism thereof;

The following detailed description of the invention refers to the accompanying drawings referred to above. Dimensions of components and features shown in the figures are chosen for convenience or clarity of presentation and are not necessarily shown to scale. Wherever possible, the same reference numbers (or the same reference numbers with letter suffixes) will be used throughout the drawings and the following description to refer to the same and like parts.

DETAILED DESCRIPTION OF EMBODIMENTS OF THE INVENTION

Figure 1A:
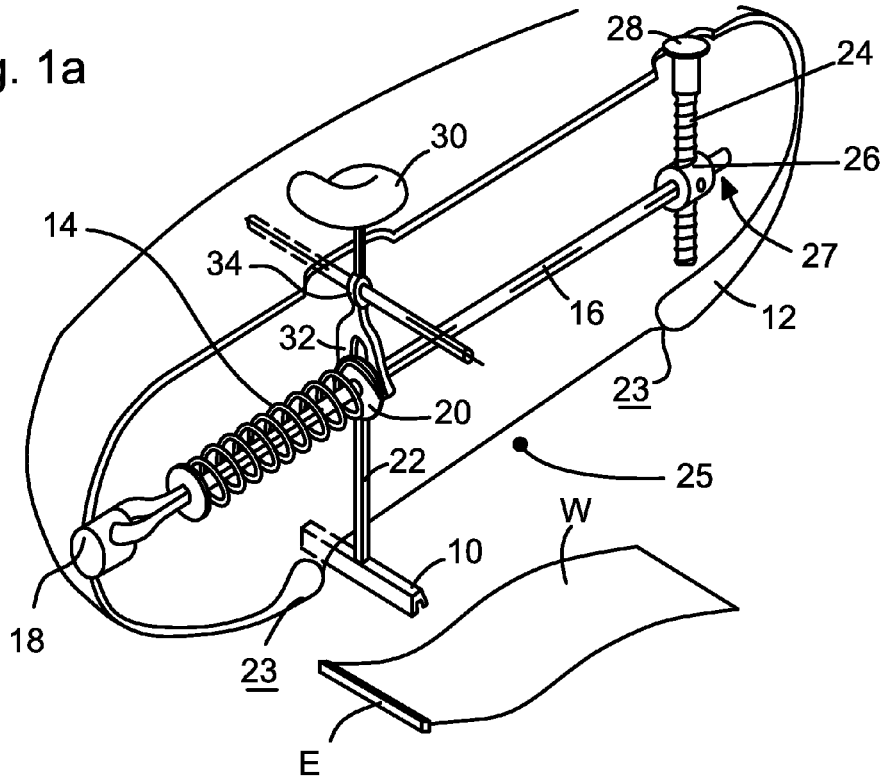
FIGS. 1*a*-1*c* are perspective cut-away views of an embodiment and modifications thereon of a hair removal device in accordance with the present invention.
Figure 1B:
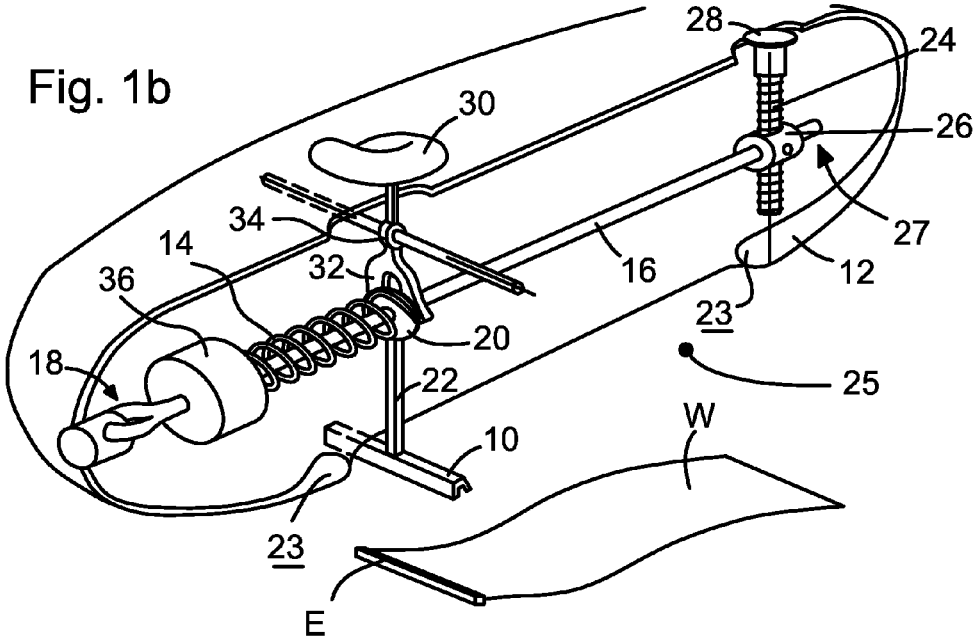
Figure 1C:
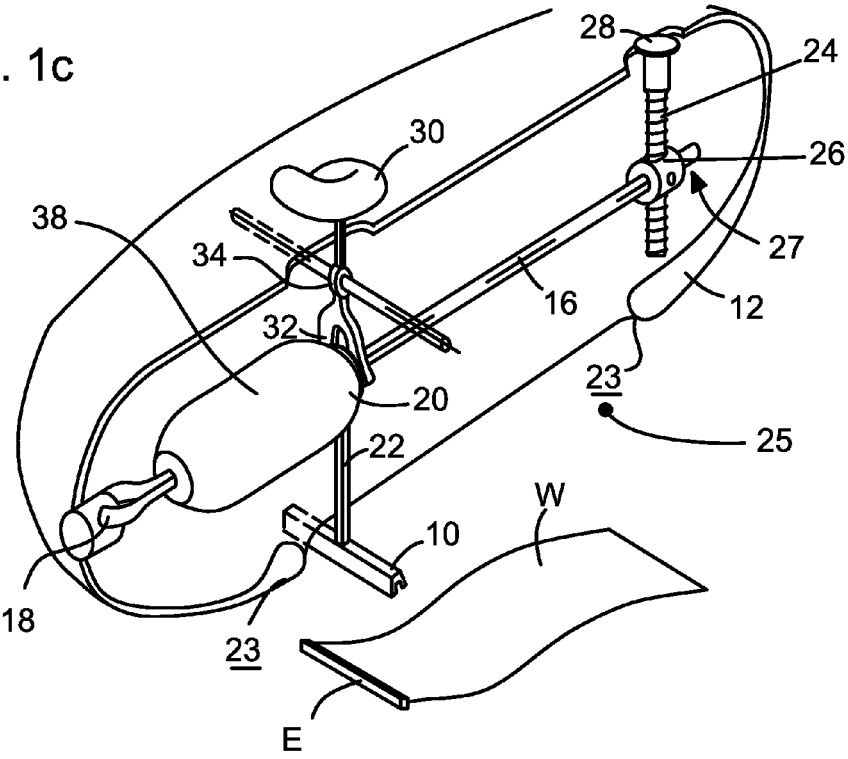

FIGS. 1*a*-1*c* show an embodiment of the present hair removal device for use in combination with a wax-strip W, and modifications thereof. The hair removal device comprises a wax-strip engagement mechanism, comprising for example a clip 10 adapted to removably hold an end or edge E of the wax-strip W; a user holding member, for example comprising a housing 12 or a handle 12*a* (referred to below); and a wax-strip removal mechanism with a wax-strip removal acceleration arrangement, exemplified by spring 14. In this embodiment, the wax-strip removal mechanism further comprises a smooth rod 16 attached to housing 12 at a pivot 18; and an acceleration arrangement holding member, such as spring compression ring 20, on rod 16, the ring having a connection member 22 connecting it to clip 10.

It is a particular feature of the wax-strip removal mechanism that rod 16 thereof is arranged, or is adjustable to be, essentially parallel to the skin of the user. Thus, in some embodiments, rod 16 can be fixed, for example, by attachment to housing 12 in a position essentially parallel to the housing's bottom surface 23 defining an opening 25. In the present embodiment, an exemplary mechanism to allow adjustment of the angle of rod 16 (i.e. the angle of pulling/removal of wax-strip W) comprises a male-female arrangement such as screw 24 and a nut 26, the nut connected to or integral with rod 16, typically at a distal end 27 thereof. Screw 24 has a head or knob 28 to affect adjustment of the rod angle.

The hair remover further comprises an actuation mechanism comprising an actuator button 30 and an actuator arm 32 pivotable at pivot point 34. Arm 32 of the actuation mechanism holds spring 14 in compression prior to actuation. To operate the device, actuator button is actuated, e.g. pushed forward, to release the energy of spring 14 thereby providing a rapidly accelerating force to pull wax-strip W backward from end E. Spring 14 rapidly propels ring 20 along rod 16 toward the rod's distal end 27 thereby pulling and removing wax-strip W backward from the skin of the user. An elongated opening 25 at the bottom of housing 12 allows the backward movement. Spring 14 can be manually recompressed to repeat the wax-strip removal process; and the wax-strip S can be replaced as needed.

FIGS. 1*b* and 1*c* illustrate modifications of the above embodiment wherein the device comprises a schematically illustrated spring recompression motor 36 for recompressing spring 14 and/or a wax-strip removal acceleration motor 38, respectively, in place of spring 14 for propelling ring 20 forward to cause the removal of wax-strip W. In some embodiments, the housing has at a rear lower end thereof a niche 40 to receive the distal end D of wax-strip W.

Figure 2A:
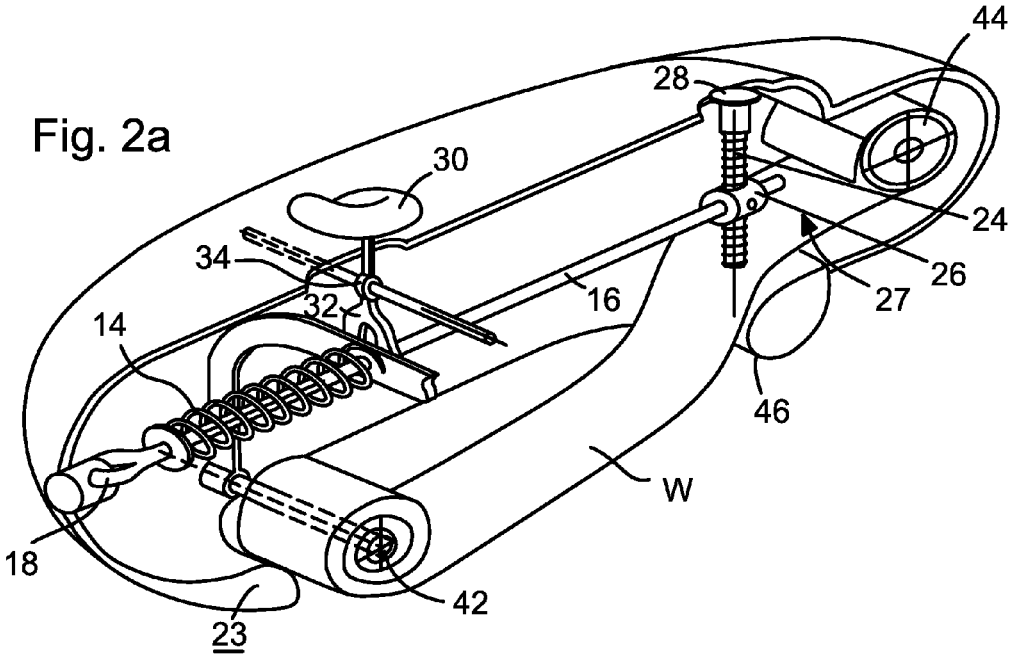
FIGS. 2*a*-2*c* are perspective cut-away views of an embodiment and modifications thereon of a hair removal device in accordance with the present invention.
Figure 2B:
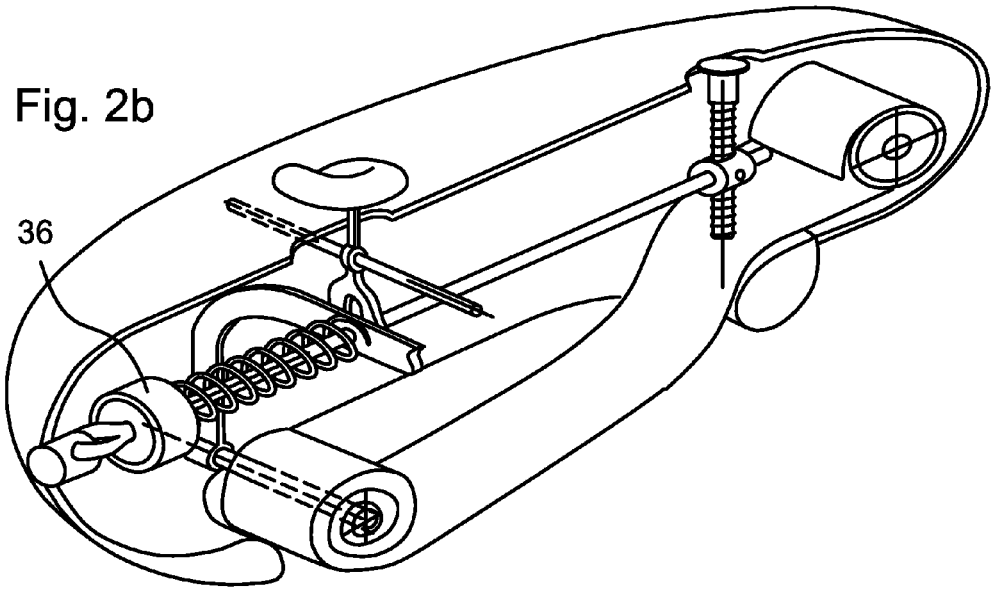
Figure 2C:
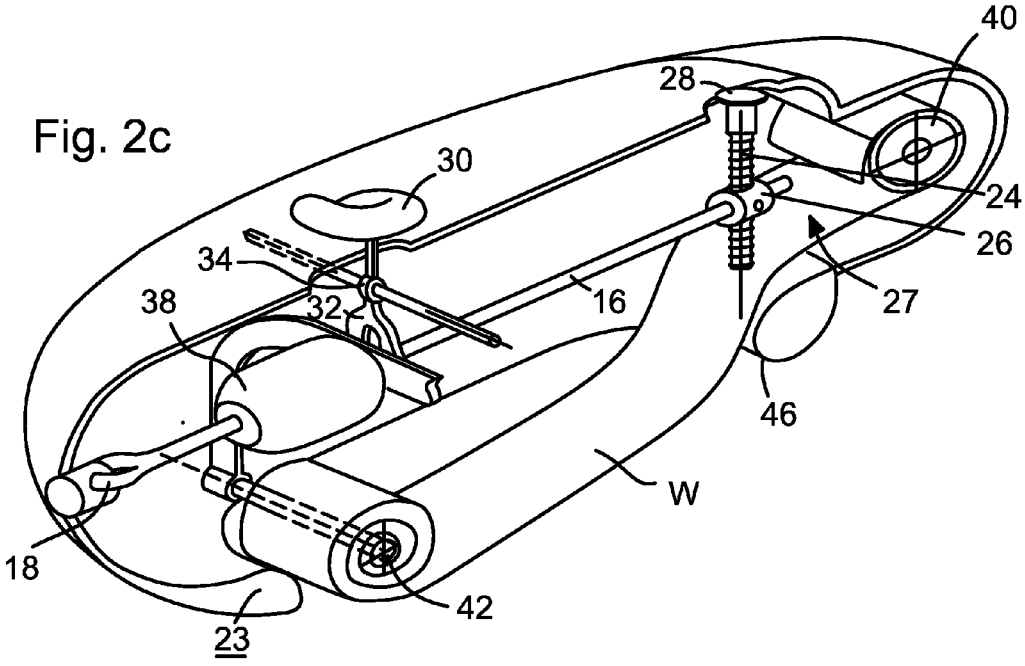

FIGS. 2*a*-2*c* show further embodiments and modifications of the present device. Here, the wax-strip W is arranged in a wound form being wound on a wax-strip holding/dispensing spool 42 at the end of the ring-clip connection member 22. According to particular embodiments, dispensing spool 42 comprises a ratchet mechanism (not visible) biased to coil the wax-strip W during operation. In certain embodiments, there is provided a wax-strip take-up spool 44 for collecting the used wax-strip W. In some embodiments, there is also a guide rail 46 to help guide the wax-strip W toward take-up spool 44. Spools 42 and 44, which may include guide rail 46 and a take-up spool housing 48, can be designed as a spool-to-spool wax-strip unit removably insertable in housing 12 for convenient replacement, as for example, toner is replaced in photocopying machines. In some embodiments, the device further comprises one or more batteries 50 (depicted for example in FIG. 3*b*) for powering spring recompression motor 36 (or wax-strip removal acceleration motor 38); while in other embodiments the motors are powered by an external electrical source, e.g. mains (not shown).

Figure 3A:
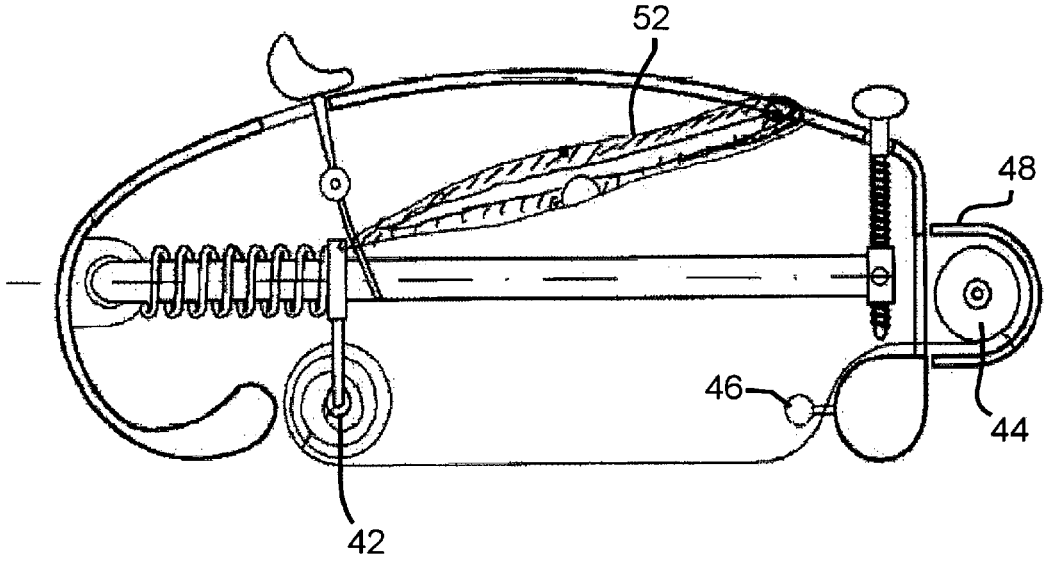
FIGS. 3*a*-3*c* are side sectional views showing further embodiments of the device.
Figure 3B:
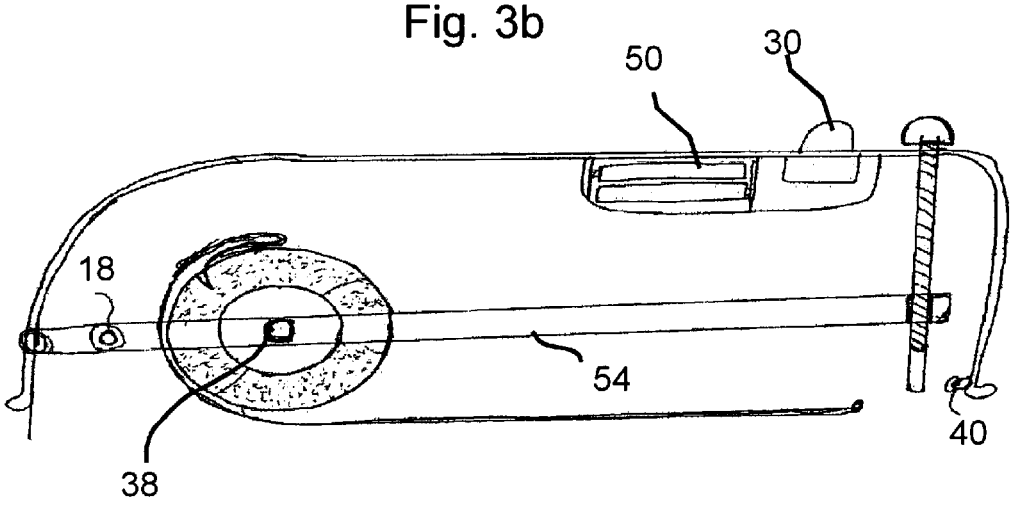
Figure 3C:
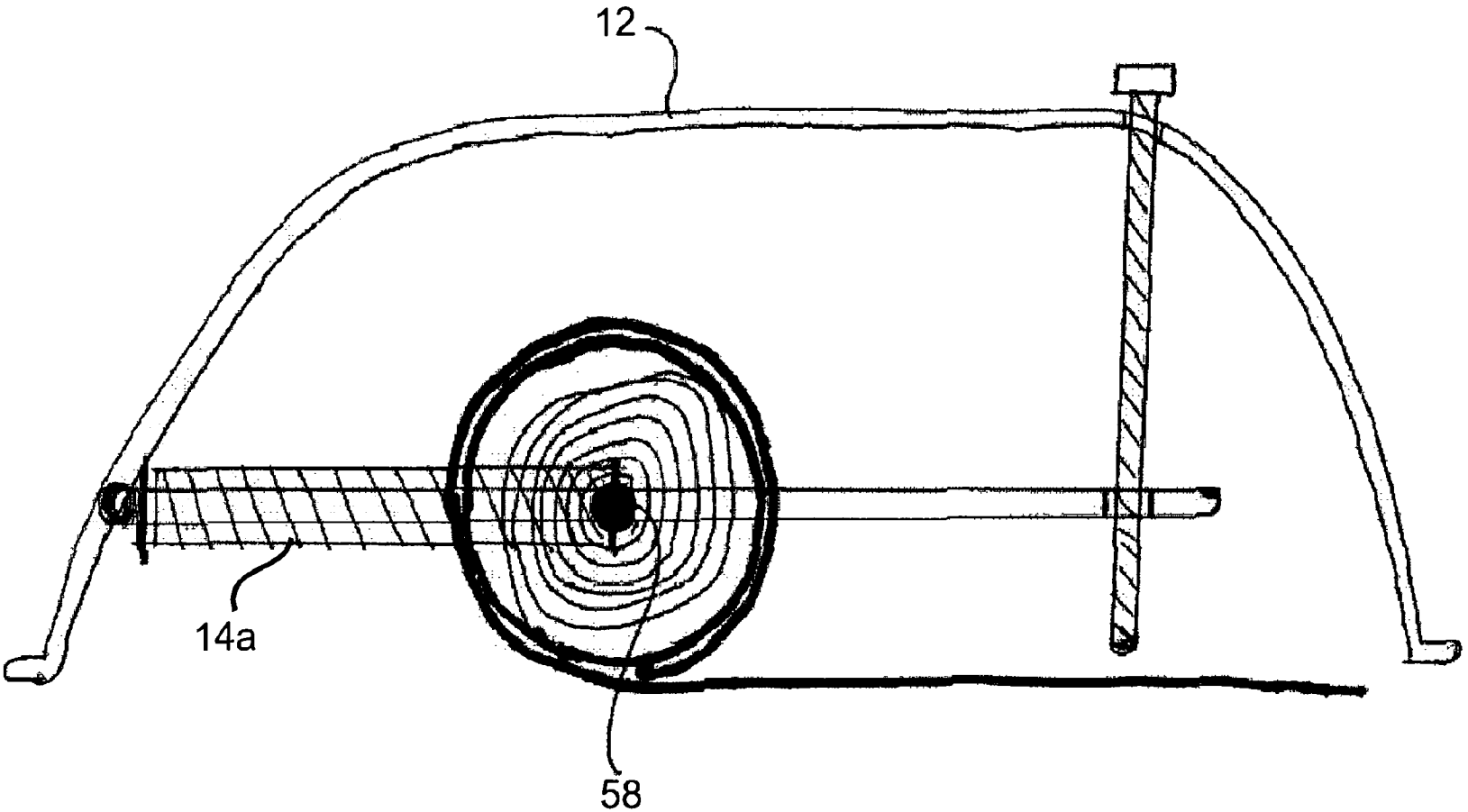

FIGS. 3*a*-3*c* illustrate exemplary embodiments of the present device with alternate wax-strip removal mechanisms comprising different wax-strip acceleration members. FIG. 3*a* shows an acceleration member having an elastic portion, for example an elastic band 52 connected between housing 12 and actuator arm 32. Elastic band 52 is stretched when in its charged position, for rapid acceleration the wax-strip W upon actuation of the device.

FIG. 3*b* depicts another variation wherein wax-strip removal acceleration motor 38 is disposed on a guide rail 54, which is generally analogous in function to rod 16. Waxstrip holding spool 42 is connected to a drive rod of motor 38, or otherwise operably connected thereto. Here, actuator button 30 activates an electric circuit rather than a mechanical actuator arm (e.g. arm 32), to initiate operation. Motor 38 can be adapted to roll up (or un-roll, depending on the desired winding of the wax-strip W) as the motor rapidly moves toward distal end 27 of rail 54 to thereby avoid slack in the wax-strip.

FIG. 3*c* illustrates another variation of the afore-mentioned embodiments wherein a rotational mechanism exemplified by a spiral spring 56 (instead of, for example, a motor such as motor 38 or other rotational means) is biased to take up slack in the wax-strip W. Spiral spring 56 is attached to the wax-strip removal acceleration arrangement, which is schematically exemplified by a hydraulic or reactive device 14*a*; in the case of a reactive device (e.g. pyrotechnic), comprising for example a device analogous to an automobile air-bag or the like to provide rapid acceleration. Spiral spring 56 comprises or is attached to a spring holder 58 which is pushed by hydraulic or reactive device 14*a* whereby the wax-strip W is rapidly removed from the user's skin while preventing slack in the wax-strip.

Figure 4A:
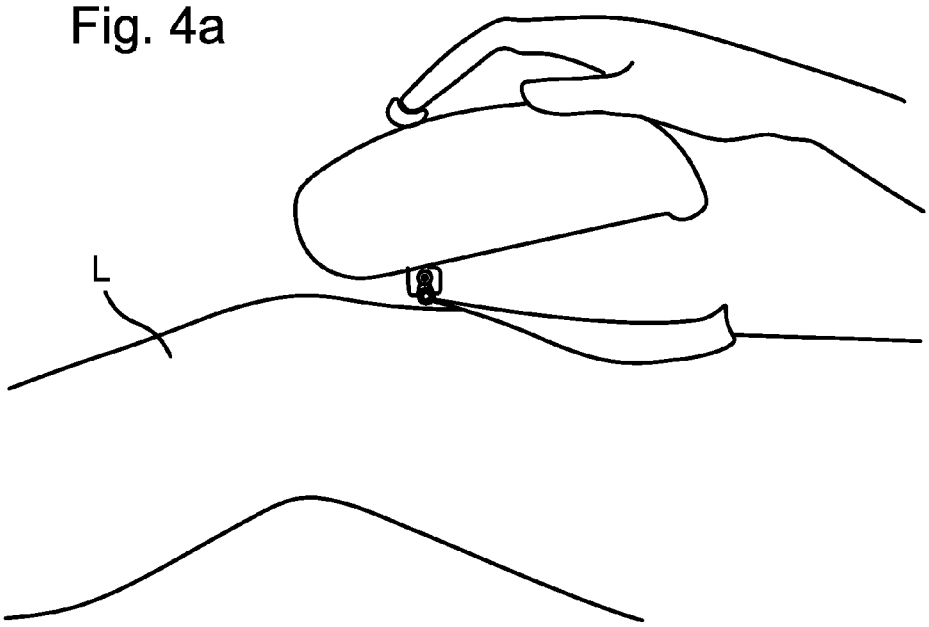
FIGS. 4*a*-4*b* show the embodiments of FIGS. 1-3 in use.
Figure 4B:
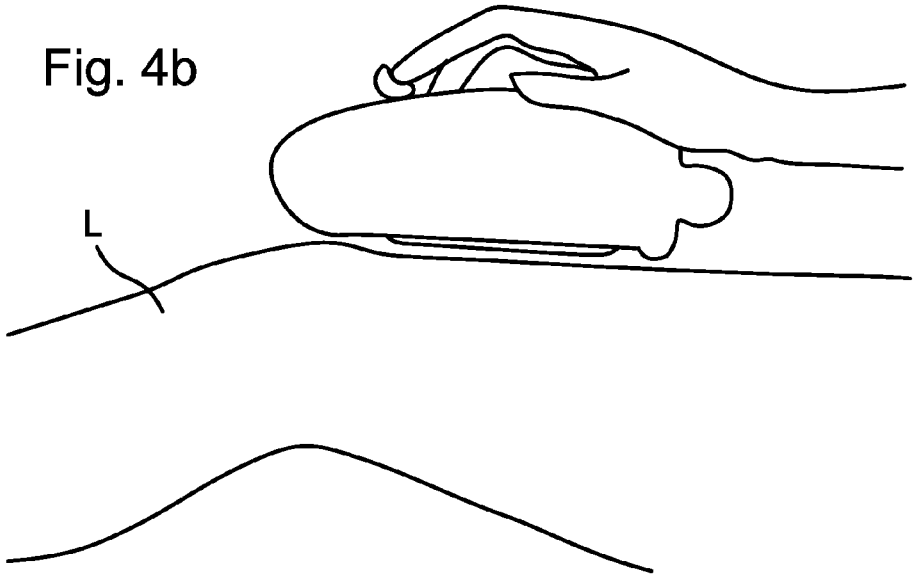

FIGS. 4*a*-4*b* show the afore-described embodiments in use for removing hair from a user's leg L.

Figure 5A:
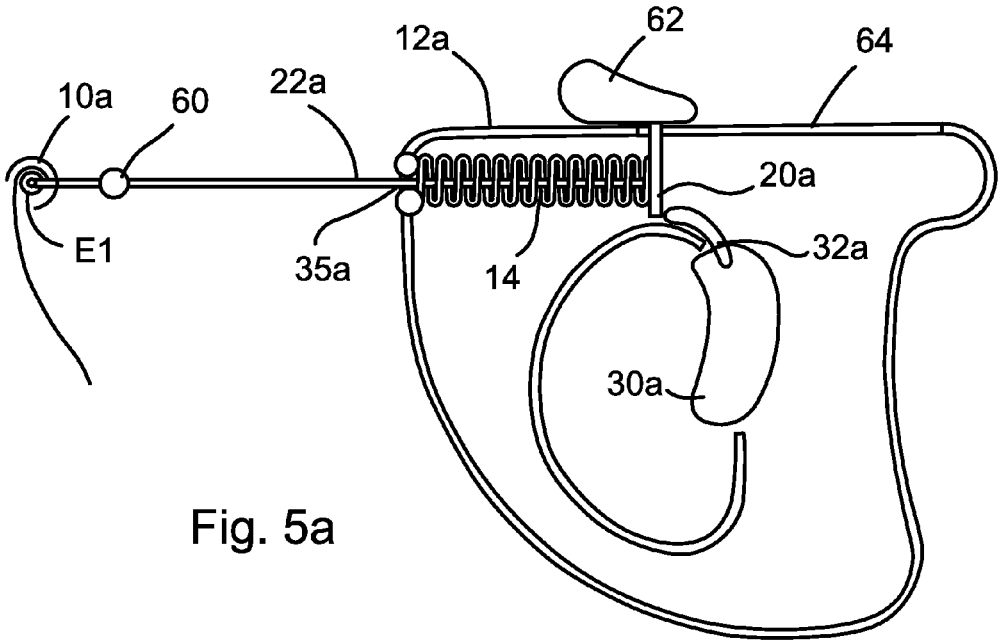
FIGS. 5*a*-5*f* are schematic views showing further embodiments of the hair removal device in a hand-held gun and trigger-like implementation of the present invention.
Figure 5B:
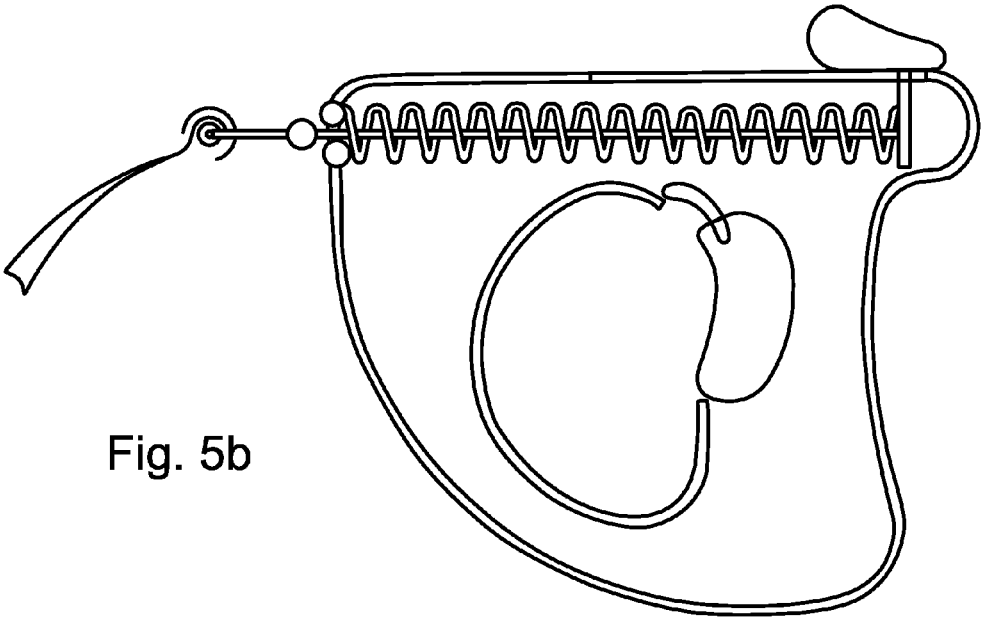

FIGS. 5*a*-5*f* show other embodiments of the hair removal device wherein the housing is in the form of a handle 12*a* having a trigger-like actuator or trigger 30*a*. Trigger 30*a* has connected thereto an actuation arm 32*a* such that when spring 14 is in the compressed position, the actuation arm blocks the acceleration arrangement holding member, in this case a spring compression member 20*a* (FIGS. 5*a*-5*d*) so that the spring remains in the compressed position. Attached to spring compression member 20*a* at one end is a connection member 22*a*, which passes through an opening 35*a* at the front of handle 12*a*. The other end of connection member 22*a* has a wax-strip engagement mechanism exemplified by a C-shaped clip 10*a* for engaging with a corresponding end or edge such as elongated circularly-profiled edge E1. In particular embodiments, the device further comprises a connection member length-adjustment device 60 that can be adjusted to shorten and lengthen connection member 22*a*. FIGS. 5*a* and 5*b* show the device in a pre-use position, with spring 14 compressed, and in a post wax-strip removal position with the spring expanded/released.

When the user is ready to remove the wax-strip W from the skin, trigger 30*a* is pulled, which moves actuation arm 32*a* to unblock spring compression member 20*a* so spring 14 will move member 20*a* backward thereby pulling connection member 22*a* to cause removal of the wax-strip W (FIG. 5*b*). The position of the handle-shaped housing (i.e. handle 12*a*) can be positioned to pull the wax-strip W at a wide range of angles, including essentially parallel to the user's skin. Spring 14 can be recompressed manually by pushing on a spring recompression button 62 slidable in an elongated opening 64 at least a small distance forward of actuation arm 32*a*.

Figure 5C:
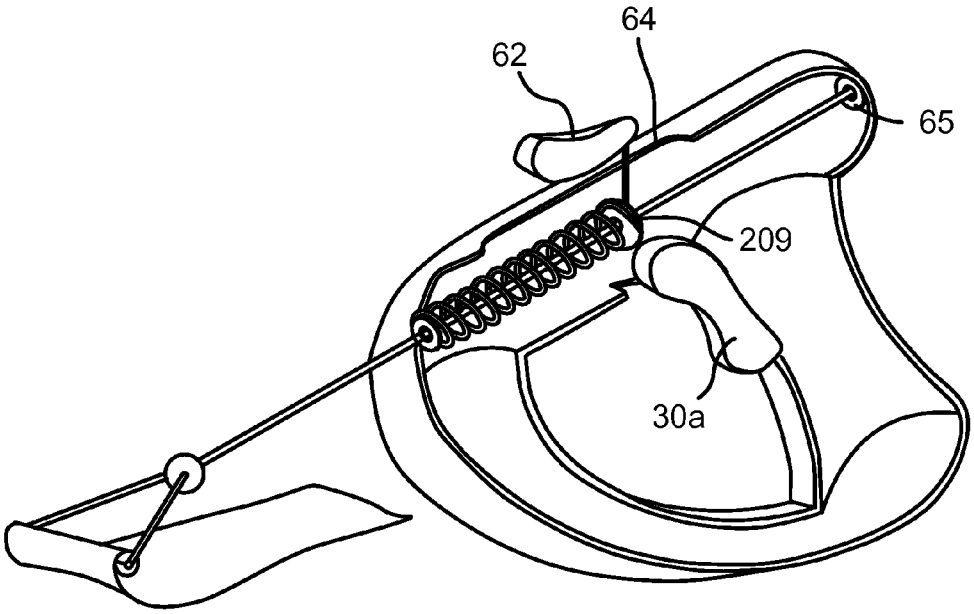

FIG. 5*c* illustrates a modification wherein connection member 22*a* is fixed to the rear wall of the handle 12*a*, and which may be, for example, fixed at that the rear wall by a fixing member 65. Also noticeable is that there is no actuator arm 32*a* and trigger 30*a* also provides the function of the actuator arm.

Figure 5D:
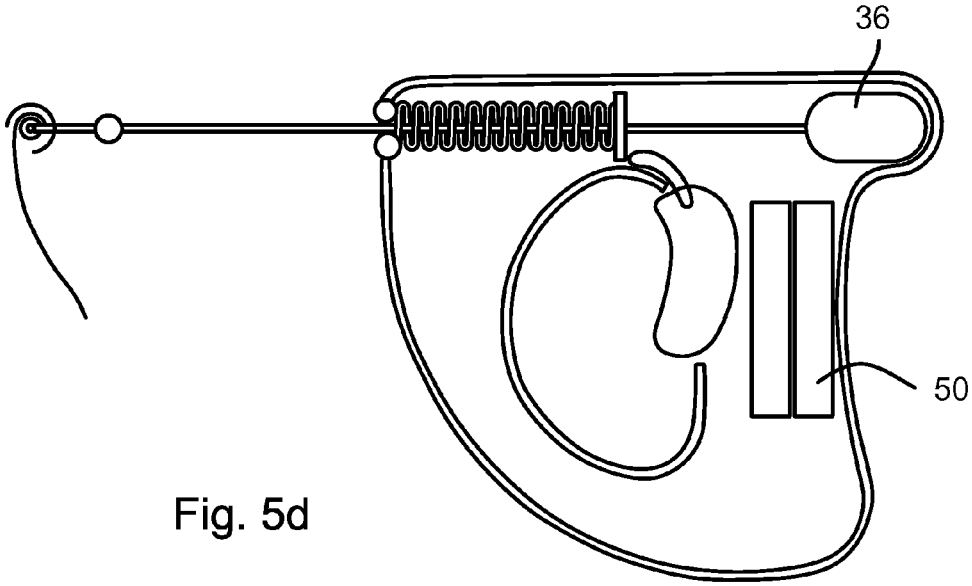
Figure 5E:
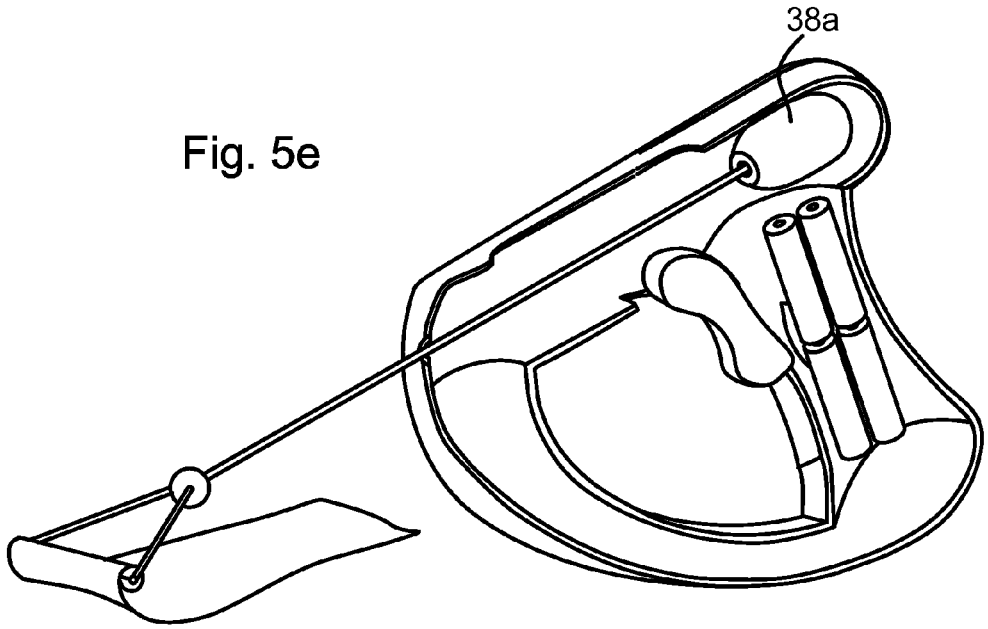
Figure 5F:
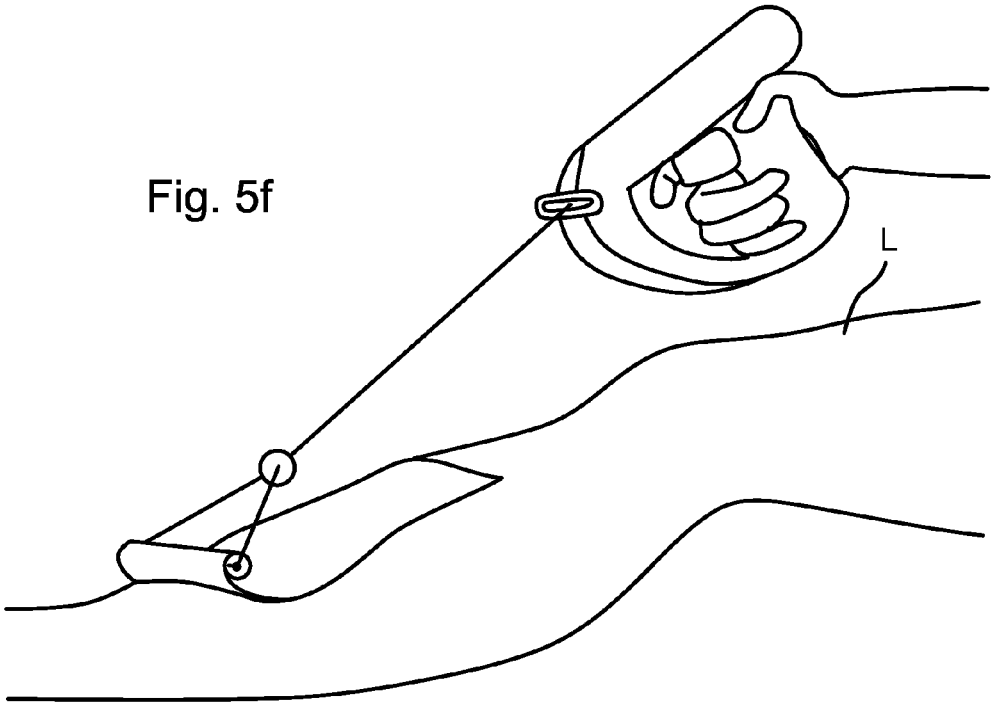

FIGS. 5*d*-5*e* show embodiments of the hair removal device wherein the hair removal device comprises spring recompression motor 36 and batteries 50; and a wax-strip removal acceleration motor 38*a* which also functions as a spring recompression motor in that the motor can cause rapid pulling on the wax-strip W by pulling connection member 22*a*, for example by winding it up; and releases, unwinds, the connection member. FIG. 5*f* shows the 'trigger handle' embodiments in use.

FIGS. 6*a*-6*g* show further exemplary embodiments of the hair removal device in which the wax-strip removal operation is performed manually.

Figure 6A:
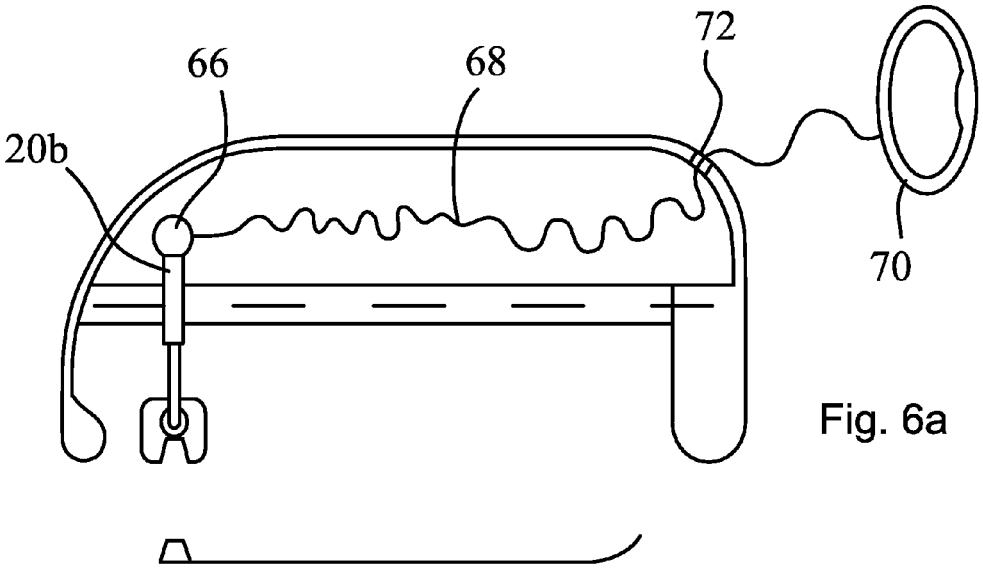

Referring first to FIG. 6*a*, the wax-strip removal mechanism comprises: an acceleration arrangement holding member exemplified by a spring compression ring 20*b*, which is analogous to ring 20 however comprising a wax-strip removal acceleration arrangement connector 66; a flexible cable or string 68 connected at one of its ends to connector 66; and a wax-strip removal mechanism in the form of a handle 70 connected to string 68 at the string's other end; and a wax-strip removal-angle control opening 72 through which string 68 passes. In some embodiments, the position of opening 72 can be adjusted, for example wherein the opening is an elongated opening having associated therewith a covering (not shown) that can be slid to cover a portion of the opening to control the effective position of the opening and thus the pulling angle of the wax-strip W relative to the skin.

Figure 6B:
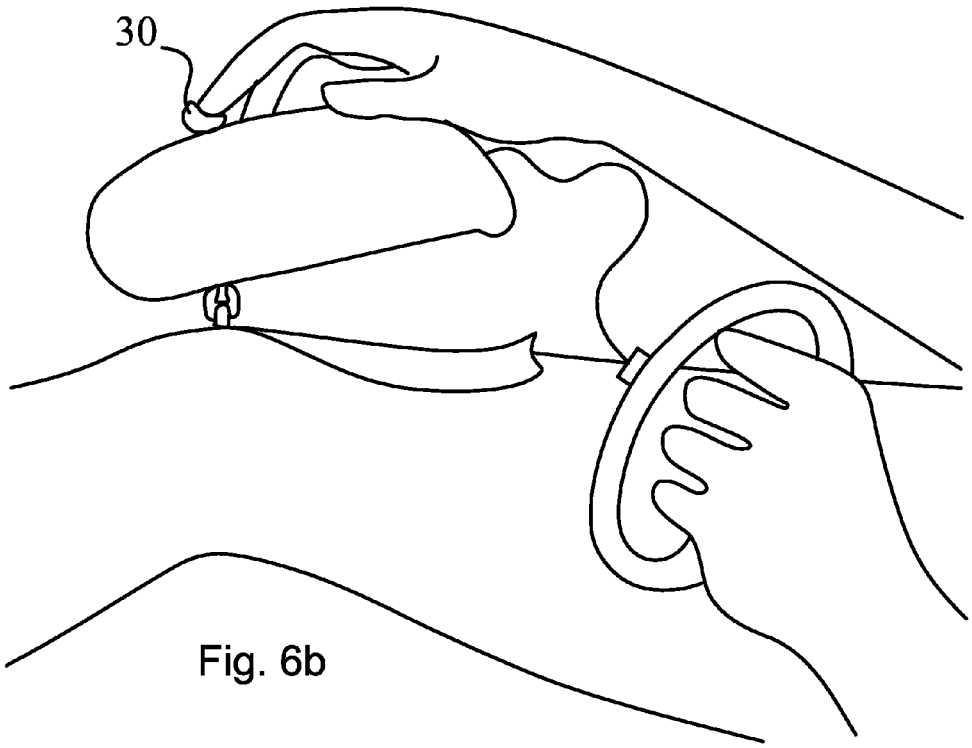
Figure 6E:
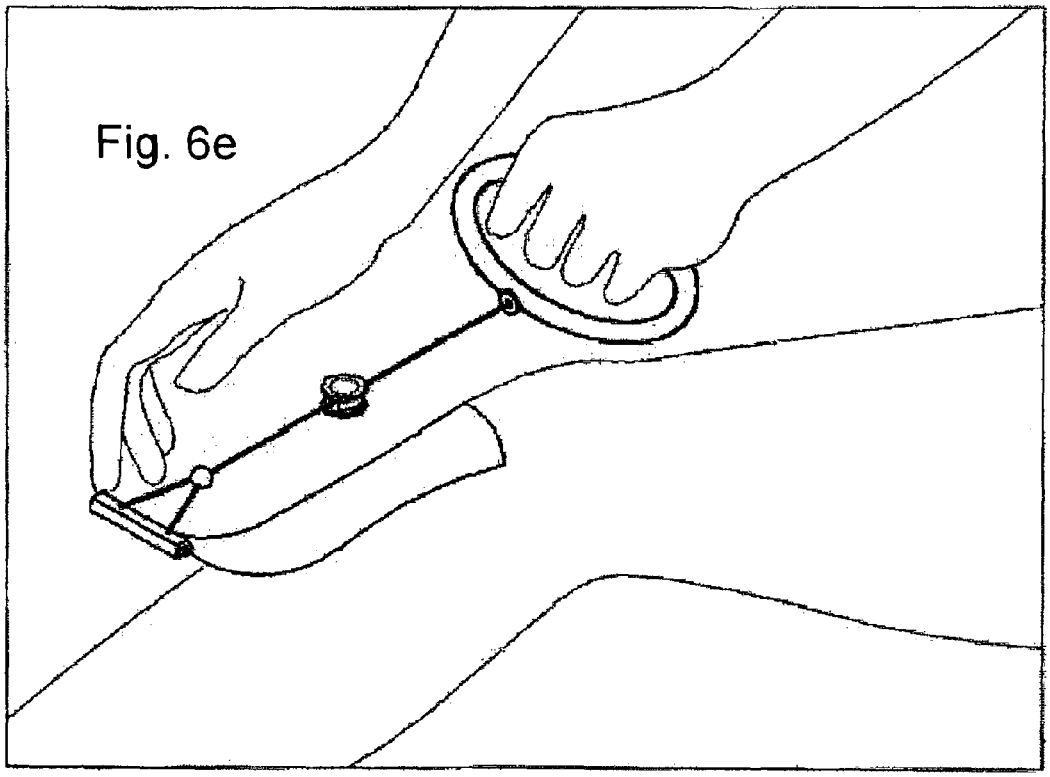

FIG. 6*b* shows the afore-mentioned embodiment in use, however further seen is actuator button 30 for returning the wax-strip removal mechanism to the pre-removal position. FIG. 6*c* illustrates a manually operable embodiment of the hair removal device wherein it has spool-like wax-strip engagement mechanism as illustrated in FIGS. 2*a*-2*c*. FIG. 6*d* shows the aforementioned embodiment in use. FIG. 6*e* depicts a simplified version of the hair removal device wherein flexible cable or string 68 is directly pulled by handle 70 to remove wax-strip W.

Figure 6F:
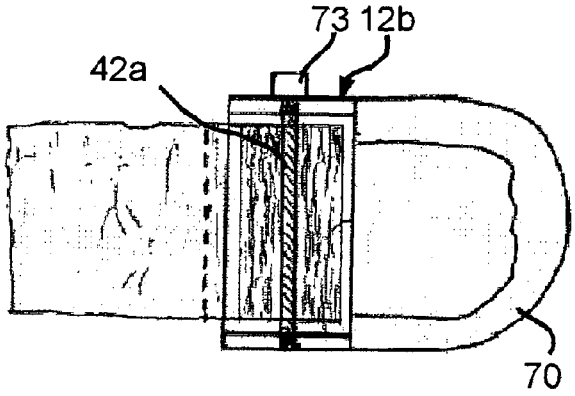

FIG. 6*f* shows another version of the device wherein handle 70 is directly connected to a cylindrical housing 12*b* having a wax-strip holding/dispensing spool 42*a* and which can be locked via a spool lock mechanism 73 to allow release (i.e. rolling out) or fixing (non-release) of wax-strip W. In some embodiments, the rolled wax-strip W has tear perforations 74 to aid in tearing used wax-strip from the unused roll. To operate the device, spool lock mechanism 73 is activated to allow release of a desired amount of wax-strip W, and then the mechanism 73 is moved to a position to stop the release. Handle 70 is then rapidly pulled at a desired angle to remove wax-strip W.

Figure 6G:
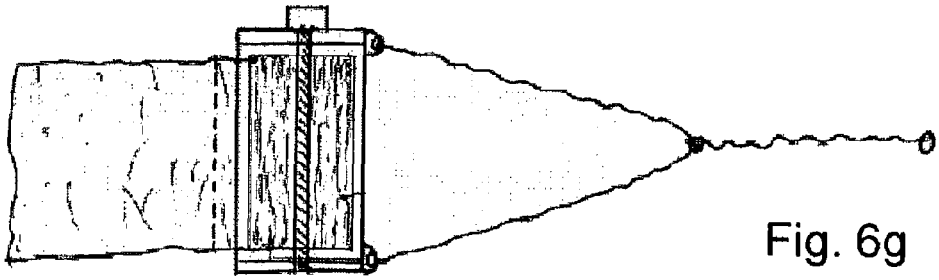

FIG. 6*g* shows an alternate design wherein the handle is constituted by a wax-strip removal acceleration arrangement as shown in FIG. 6*e*.

While using the device having a manual acceleration mechanism (i.e. manually pulling), during the wax-strip removal procedure, it is preferable that handle 70 is first moved forward producing slack in string 68 so that when handle 70 is pulled, there is already a finite pulling speed at front edge E of wax-strip W at the time when there is no longer slack the string (i.e. the string is taut and the wax-strip removal commences).

Figure 7A:
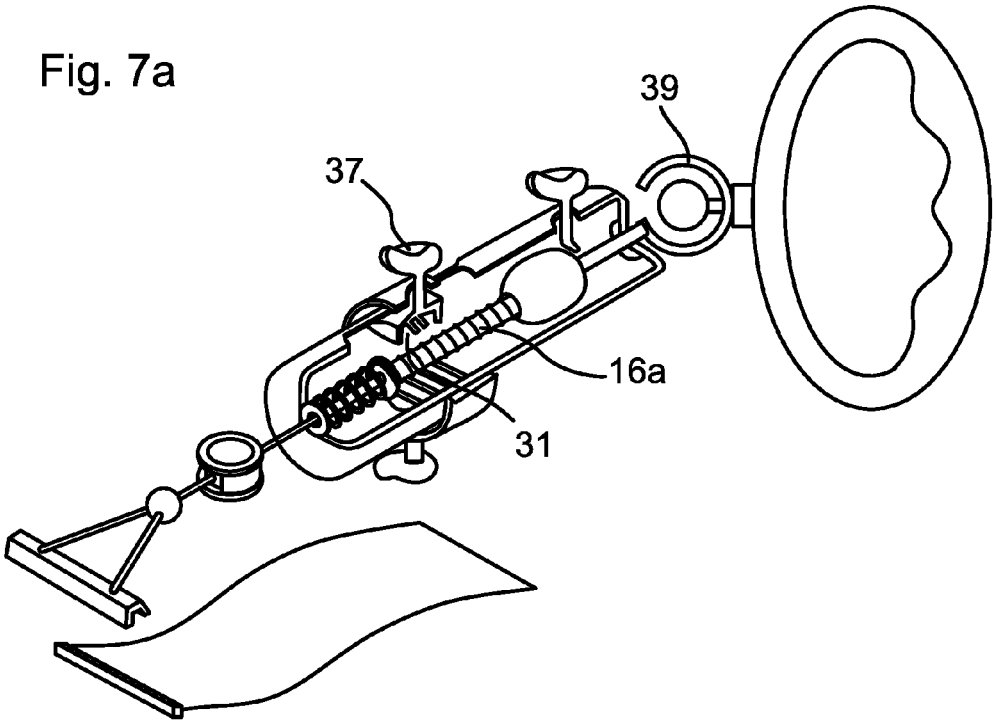
FIGS. 7*a*-7*b* show an embodiment of the device wherein it comprises multiple operation options.
Figure 7B:
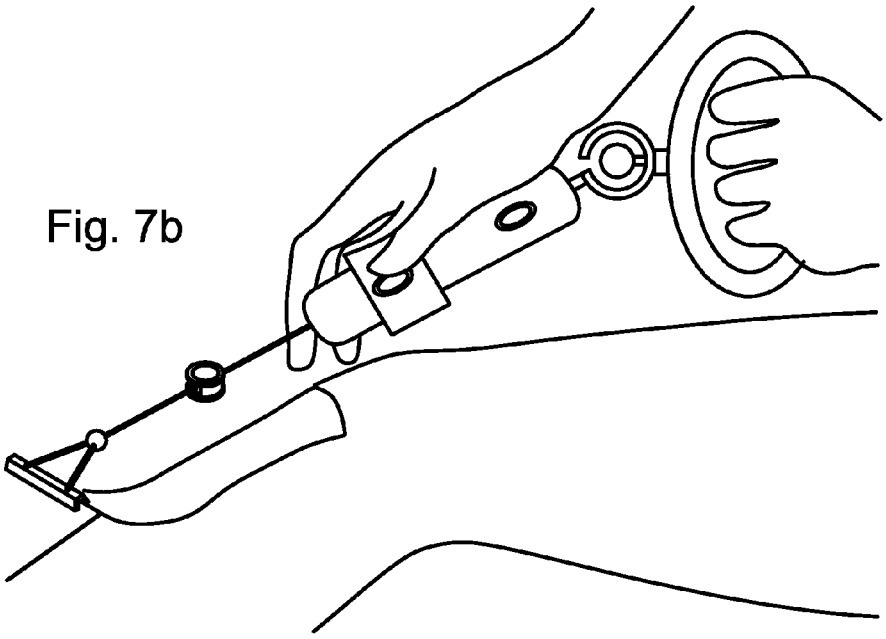

FIGS. 7*a*-7*b* show an embodiment of the device wherein it comprises multiple operation options; as well as illustrate details of a spring recompression mechanism. Here, the user moves actuator 30, which has prongs 31 at the bottom of the actuator, to disengage from the threads threaded rod 16*a*. This allows spring 14 to decompress and pull the wax-strip W during the spring's expansion. As a result, actuator 30 is also moved backward in elongated opening 35 toward spring recompression motor 36. To recompress the spring 14, the user presses actuator 30 to reengage prongs 31 into contact with threaded rod 16*a*, and then actuates spring recompression motor 36 via spring recompression motor actuator 37 thereby turning the threaded rod to move compression actuator 30 forward to the ready position. In some embodiments the device further comprises a manual pulling option, which in some modifications includes a pulling angle freedom device, for example a ball and socket arrangement 39 for facilitating pulling handle 70 at various angles.

FIGS. 8*a*-8*c* illustrate another embodiment of the hair removal device similar to that of FIG. 6*f* however comprising a wax-strip engagement mechanism constituted by a screw or snap-down closure 10*b* having tightening means 76 at the ends thereof or an alligator closure 10*c*, respectively. FIG. 8*a* shows alligator closure 10*c* in an open opposition and connected to handle 70.

Figures 9A, 9B, 9C, 9D, 9E, 9F:
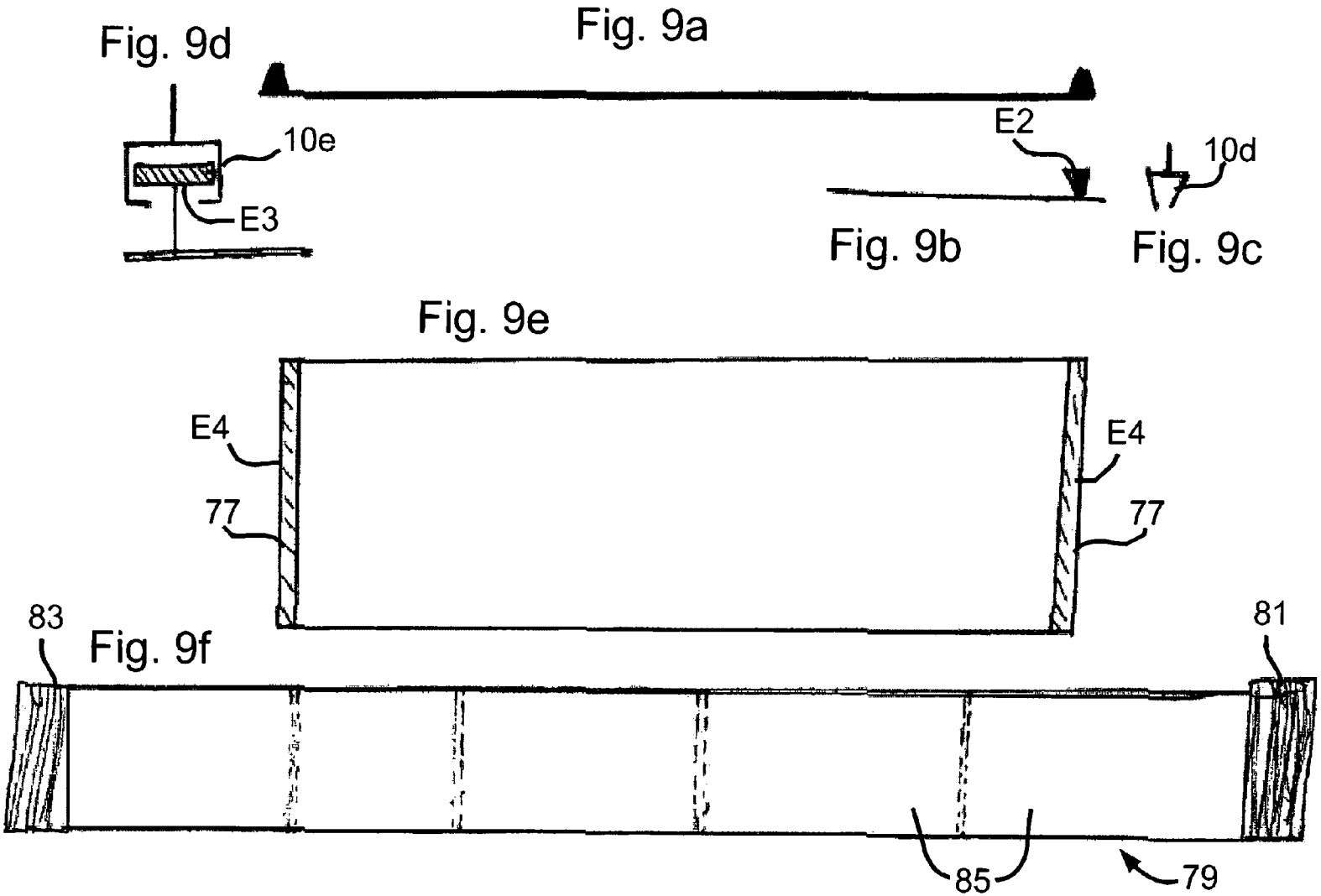
FIGS. 9*a*-9*f* illustrate a number of exemplary types of wax-strips and/or wax-strip engagement mechanisms of the present device.

FIGS. 9*a*-9*f* illustrate a number of exemplary types of wax-strips and/or wax-strip engagement mechanisms that can be used in the present device. FIG. 9*a* shows a wax-strip W having edges E at both ends thereof. FIG. 9*b* shows a wax-strip W having another exemplary edge E2 with upside down triangular profile, suitable to correspond with a downwardly tapering wax-strip engagement mechanism 10*d* (FIG. 9*c*). FIG. 9*d* shows a C-shaped wax-strip engagement mechanism 10*e* suitable for use with a T-shaped wax-strip edge E3. FIG. 9*e* shows wax-strip W with an edge E4 (or edges) capable of being grabbed or having stickable recesses 77 or being soldered. FIG. 9*f* shows a wax-strip roll cassette 79 having rolls 81 and 83; and having wax-strip sections 85.

Figure 10D:
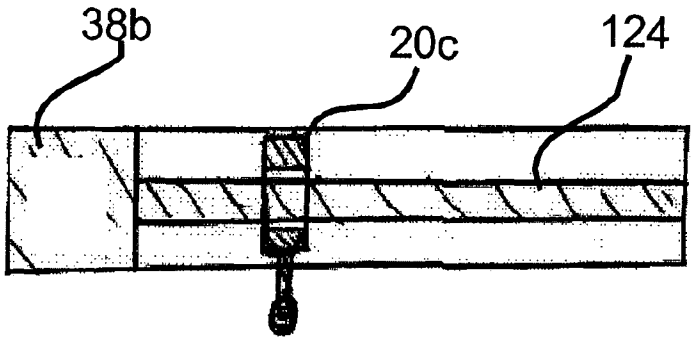
FIGS. 10*a*-10*d* schematically illustrate a number of exemplary acceleration members usable in the present hair removal device.
Figure 10A:
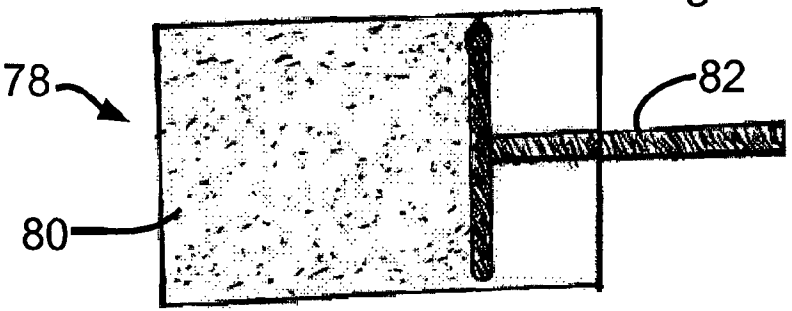
Figure 10B:
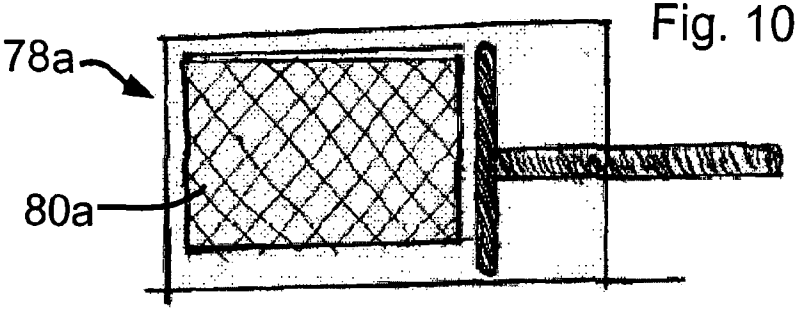

FIGS. 10*a*-10*d* illustrate a number of exemplary acceleration members, in particular of piston-like acceleration members of wax-strip removal mechanisms. FIG. 10*a* depicts a compression-type piston and cylinder 78 comprising therewithin a compressible material, for example gas 80 and a piston rod 82 whose movement affects removal of the wax-strip W. FIG. 10*b* shows a piston and cylinder 78*a* comprising a resilient material 80*a* therein.

Figure 10C:
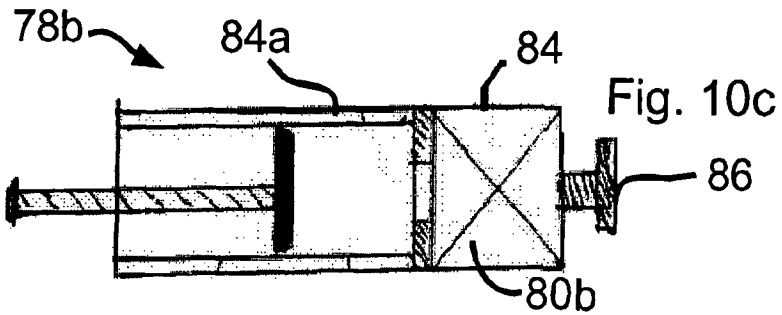

FIG. 10*c* shows a piston and cylinder type mechanism 78*b* comprising a doublecompartmented cylinder; a first cylinder portion 84 for storing a reactive or explosive material 80*b*; and a second cylinder portion 84*a* into which reacted or exploded material (e.g. pyrotechnic material) enters which propels piston 82. Mechanism 78*b* typically further comprises a pressure relief valve 86.

FIG. 10*d* illustrates an exemplary alternative wax-strip removal acceleration arrangement in the form of a wax-strip translating device with a motor 38*b* for rotating a drive rod 124 causing a ring 20*c* to rapidly move back and forth to affect pulling of the wax-strip W.

Figure 11A:
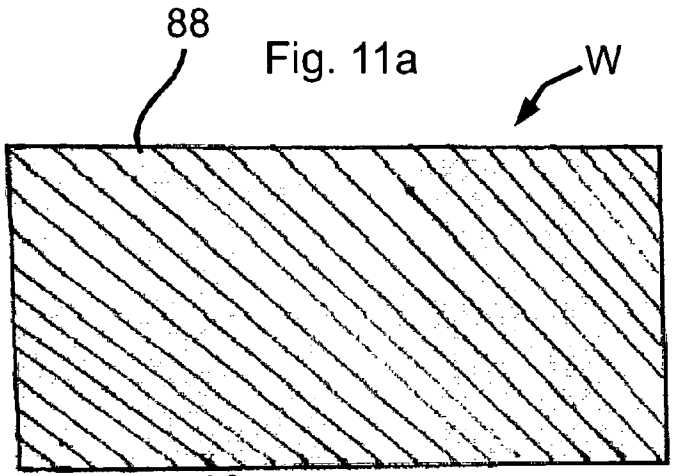
FIGS. 11*a*-11*d* illustrate a number of exemplary types of alternate reusable waxstrips.
Figure 11B:
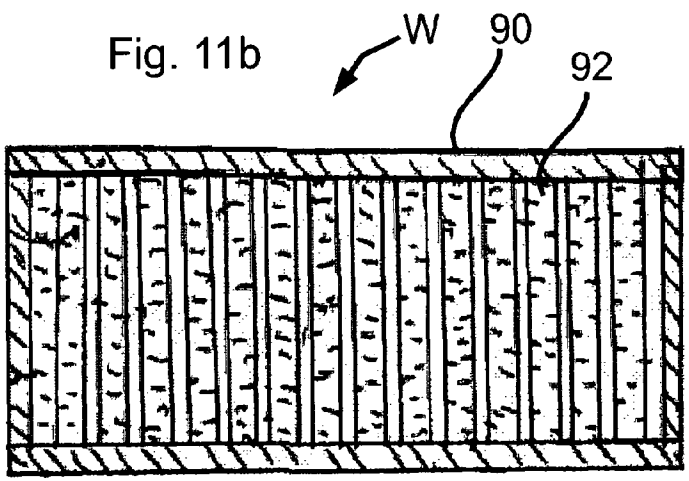
Figure 11C:
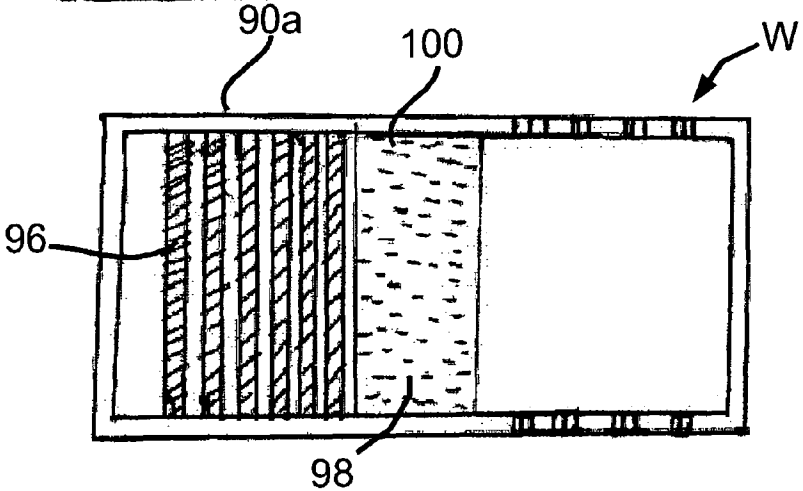
Figure 11D:
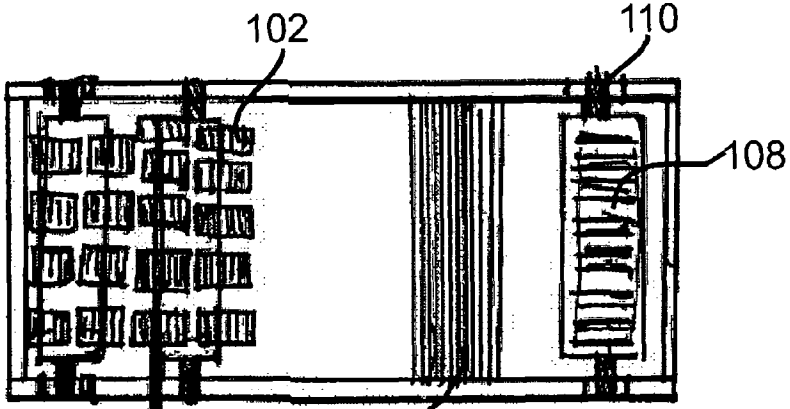

FIGS. 11*a*-11*d* illustrate a number of exemplary types of alternate reusable wax-strips W. FIG. 11*a* shows the wax-strip W made of a flexible material and having elongated slits 88 for grabbing hair. FIG. 11*b* shows the wax-strip W comprising a flexible or articulated frame 90 with flexible material such as rubber bands 92 stretched across. FIG. 11*c* shows the wax-strip W comprising a flexible or articulated frame 90*a* wherein the flexible material comprises stretchable springs 96, which may be in combination with a flexible sheet 98 having a plurality of hair grabbing slits 100. Beni: what are parts 8 in your FIG. 3 on page 55?. In FIG. 11*d* the wax-strip W comprises an array of cogwheels 102 which roll on the skin thereby grabbing the hair, and which can be turned by a knob 104. In some embodiments, the wax-strip W further comprises thin rubber bands 106 adjacently arranged for grabbing and tearing out hair; and/or opening and adjacently disposed closing lips 108 with a pivotal rotation means 110.

Figures 12A, 12B, 12C, 12D, 12E, 12F, 12G, 12H:
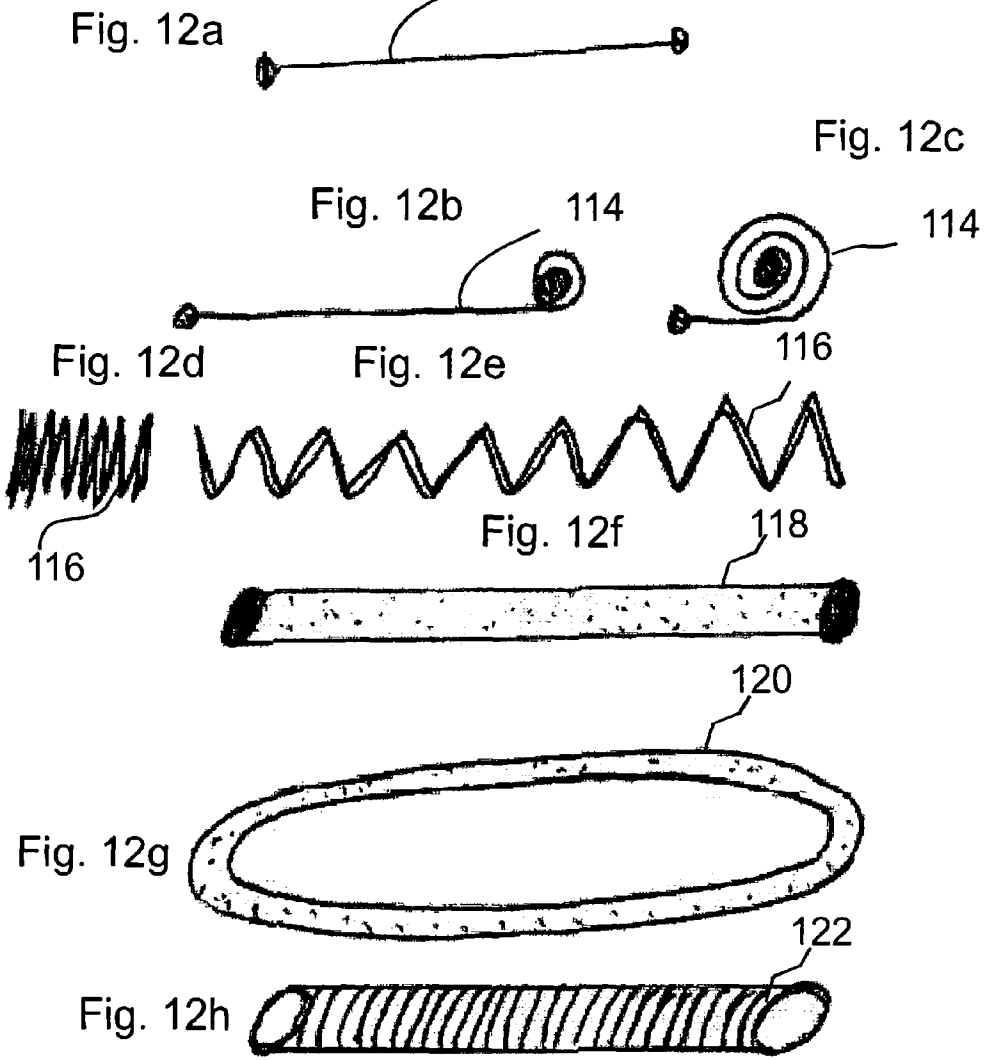
FIGS. 12*a*-12*h* illustrate a number of exemplary elastic or expanding acceleration members.

FIGS. 12*a*-12*h* illustrate a number of exemplary elastic or expanding acceleration members; wherein FIG. 12*a* shows a strip 112 made of an elastic flexible material, such as a plastic or metal material which is bendable and returnable to its initial state for charging and discharging the hair removal device; FIGS. 12*b* and 12*c* show a springlike metallic or plastic material 114 in an open and coiled configuration, respectively; FIGS. 12*d* and 12*e* show another type of charging and discharging member comprising a metal or plastic material in the form of accordion 116 in its closed and open configuration, respectively; FIGS. 12*f* and 12*g* show an elongated cylindrically-shaped and a loop-shaped charging and discharging members 118 and 120, respectively, made of a flexible material such as rubber; and FIG. 12*h* shows a spiral spring charging and discharging member 122.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A hair removal device using, or for use in combination with, a wax-strip configured to remove hair from skin, the device comprising:

a user holding member comprising a housing having a wax-strip removal mechanism actuator, the housing having a bottom surface configured for engaging with the skin;

a wax-strip engagement mechanism for removable engagement with the wax-strip; and a wax-strip removal mechanism comprising a wax-strip removal acceleration arrangement, wherein the wax-strip removal mechanism is disposed, or adjustable, to apply a pulling force on the wax-strip at a range of angles relative to the bottom surface of the housing including essentially parallel to the bottom surface; and the wax-strip removal acceleration arrangement comprises a spring or elastic member, which is configured to accelerate removal of the wax strip.

2. The device according to claim 1, wherein the wax-strip engagement mechanism comprises a clip.

3. The device according to claim 1, further comprising a screw and nut to adjust the angle of the pulling force.

4. The device according to claim 1, wherein the wax-strip engagement mechanism comprises a spooling arrangement to hold the wax-strip.

5. The device according to claim 4, wherein the spooling arrangement comprises a wax-strip dispensing spool and a wax-strip take-up spool.

6. The device according to claim 1, further comprising a return mechanism for the wax-strip removal acceleration arrangement.

* * * * *